US006079261A

United States Patent [19]

Mäkelä

[11] Patent Number: 6,079,261

[45] Date of Patent: Jun. 27, 2000

[54] METHOD AND ARRANGEMENT FOR LEVELLING OUT TENSION VARIATION OF AN OPTICAL FIBRE

[75] Inventor: Keijo Mäkelä, Espoo, Finland

[73] Assignee: Nextrom Holding S.A., Switzerland

[21] Appl. No.: 09/068,727

[22] PCT Filed: Nov. 15, 1996

[86] PCT No.: PCT/FI96/00620

§ 371 Date: May 21, 1998

§ 102(e) Date: May 21, 1998

[87] PCT Pub. No.: WO97/19376

PCT Pub. Date: May 29, 1997

[30] Foreign Application Priority Data

Nov. 17, 1995 [FI] Finland ..... 955563

[51] Int. Cl.[7] ..... G01L 5/04

[52] U.S. Cl. ..... 73/160; 73/828

[58] Field of Search ..... 73/800, 812, 826, 73/828, 831, 160

[56] References Cited

U.S. PATENT DOCUMENTS

| | | | |
|---|---|---|---|
| 3,951,321 | 4/1976 | Heusser | 226/97 |
| 4,692,615 | 9/1987 | Mensah et al. | 356/73.1 |
| 5,048,281 | 9/1991 | Dallmann et al. | 57/264 |
| 5,233,200 | 8/1993 | DiMarcello et al. | 250/559.29 |
| 5,710,432 | 1/1998 | Bell | 250/559.32 |

FOREIGN PATENT DOCUMENTS

| | | |
|---|---|---|
| 0 253 636 A1 | 1/1988 | European Pat. Off. . |
| 0 338 856 A2 | 10/1989 | European Pat. Off. . |
| 0 534 408 A1 | 3/1993 | European Pat. Off. . |

*Primary Examiner*—Max Noori

*Attorney, Agent, or Firm*—Nixon & Vanderhye P.C.

[57] ABSTRACT

The invention relates to a method and arrangement for levelling out tension variation of an optical fibre when the fibre is wound on or off a reel, the basic tension of the fibre being provided by means of a dancer. To allow tension to be rapidly levelled out, the fibre is arranged to be deflected between two support and guide means by means of a transverse jet of a gaseous medium generated by a nozzle means mounted in a transverse position in relation to the direction of travel of the fibre.

11 Claims, 3 Drawing Sheets

METHOD AND ARRANGEMENT FOR LEVELLING OUT TENSION VARIATION OF AN OPTICAL FIBRE

BACKGROUND OF THE INVENTION

The invention relates to a method for levelling out tension variation of an optical fibre when the fibre is wound on or off a reel, the basic tension of the fibre being provided by means of a dancer. The invention also relates to an arrangement for levelling out tension variation of an optical fibre when the fibre is wound on or off a reel, the basic tension of the fibre being provided by means of a dancer.

In connection with treatment of optical fibres, it has been found that when an optical fibre is wound on or off a reel, it is disadvantageous that the tension of the fibre varies. Too high a tension may have a detrimental effect—either temporary or permanent—on the optical properties of the fibre. Too low a tension, in turn, may lead to formation of "loose loops" when the fibre is wound on a reel; such loops cause attenuation steps in the measurement results.

Tension variations are also disadvantageous in the treatment processes of the fibre. When a fibre is wound off a reel for coating, for instance, tension variation may make the fibre vibrate, which results in unequal wall thickness of the fibre coating.

When a fibre is wound off a reel, tension variations occur, for example, because of uneven winding rate, which may result from eccentricity of the reel or unevenly performed winding of the fibre on the reel. Tension variations also occur when a fibre is wound on a reel on account of an uneven reel, eccentricity, clearings, etc. Eccentricities of guide wheels on the fibre path, clearings, friction variations of bearings, etc., also cause tension variations in the fibre. In addition, tension variations are caused by air flows and other ambient disturbances which make the fibre vibrate. Resonance frequencies must also be borne in mind. Yet another source of tension variations is forces exerted on the fibre by static electricity.

Several solutions have been provided for controlling tension variations. As a first example can be mentioned balanced lever dancers, which tend to level out tension. The disadvantage of this solution is its response speed, which is limited by the law $a=F/m$. The drawbacks of the solution thus result from the inertial forces of mass.

A second example of known solutions is lever dancers operated by a spring, compressed air or the like. In such solutions, the proportion of mass to force may be lower than in the previous example, wherefore $a=F/m$ is more advantageous and the solution is faster than that of the first example. However, the velocity of even this known solution is not always sufficient for levelling out rapid tension variations.

A third example of known solutions is linear dancers. They have the same drawbacks as the examples described above.

A fourth example is tension-controlled hauling devices, such as capstans. These solutions have the same drawback as the examples described above, i.e. their velocity is not sufficient. In addition, such a construction is expensive—extremely expensive if the device is to be very fast.

SUMMARY OF THE INVENTION

The object of the present invention is to provide a method and an arrangement by which the drawbacks of the prior art can be obviated. This is achieved with the present invention.

The method of the invention is characterized by deflecting the fibre to compensate for tension variations caused by the inertia of the dancer between two support and guide means by means of a jet of a gaseous medium transverse in relation to the direction of travel of the fibre. The arrangement of the invention is characterized in that, to compensate for tension variations caused by the inertia of the dancer, the fibre is arranged to be deflected between two support and guide means by means of a transverse jet of a gaseous medium generated by a nozzle means mounted in a transverse position in relation to the direction of travel of the fibre.

An advantage of the invention is that it allows tension variation to be levelled out rapidly, wherefore the drawbacks caused by the tension variation can be eliminated efficiently. The invention thus improves the workability of the prior art solutions: slow tension variations are controlled by conventional solutions, e.g. dancers, whereas rapid tension variations are controlled by the method and arrangement of the invention. Another advantage of the invention is that it has a simple construction, and thus the start-up and operating costs will be low.

In the following, the invention will be described in greater detail by means of preferred embodiments illustrated in the accompanying drawings.

DETAILED DESCRIPTION OF THE DRAWINGS

Figure 1:
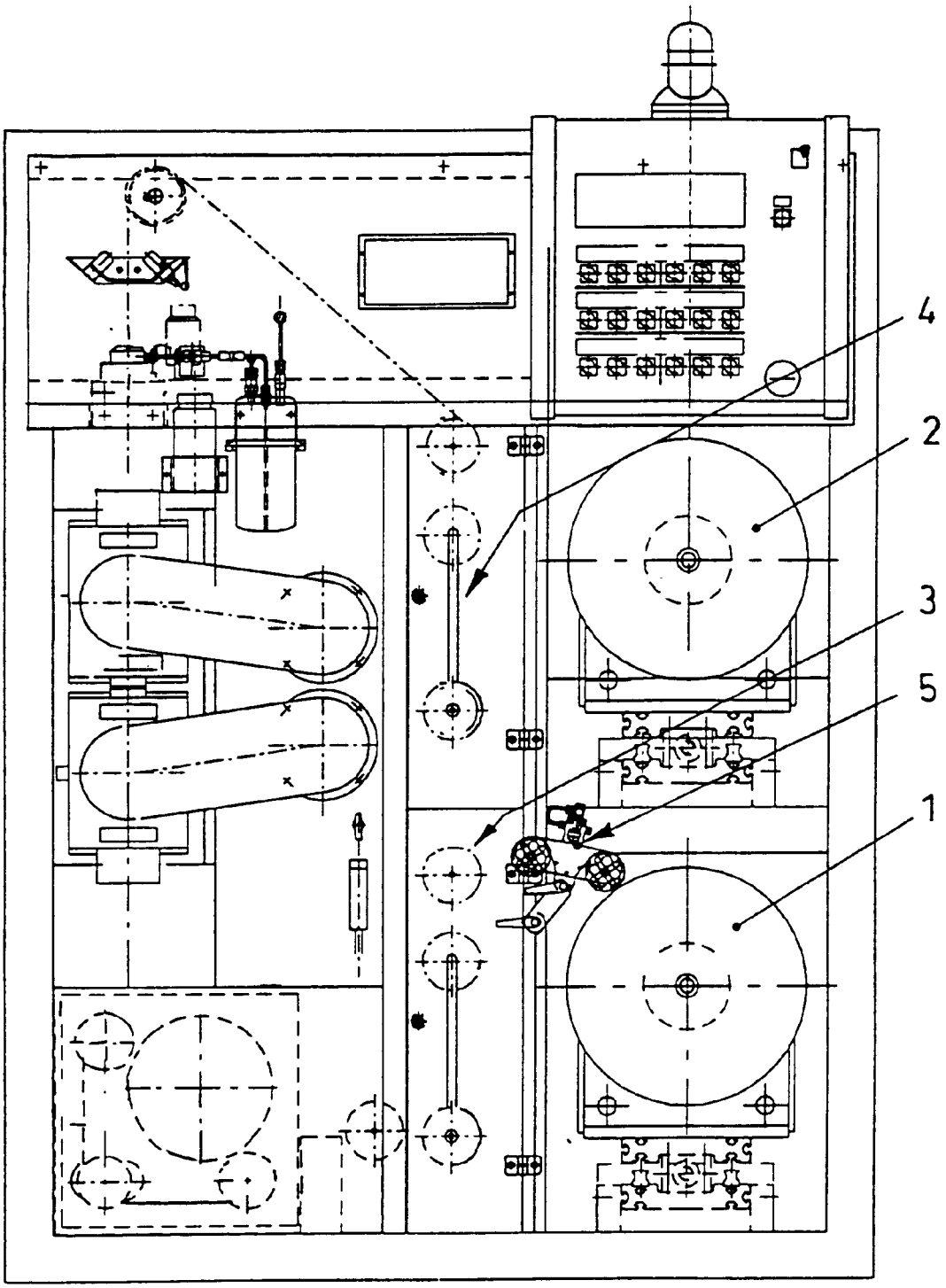
FIG. 1 is a general side view of a spooler provided with an arrangement of the invention.

FIG. 1 is a general view of an apparatus for winding an optical fibre. The apparatus of FIG. 1 further comprises means for colouring the fibre. Apparatuses of this kind are known per se to one skilled in the art, wherefore the structure and operation of the apparatus will not be described more closely herein. It will only be stated that reference numerals 1 and 2 indicate the reels on which an optical fibre can be wound. Reference numerals 3 and 4 indicate lever dancers which provide a basic tension for the optical fibre. The lever dancers maintain an average tension in the fibre. Reference numeral 5 indicates the arrangement of the invention, which is shown on a larger scale in FIGS. 2 and 3.

Figure 2:
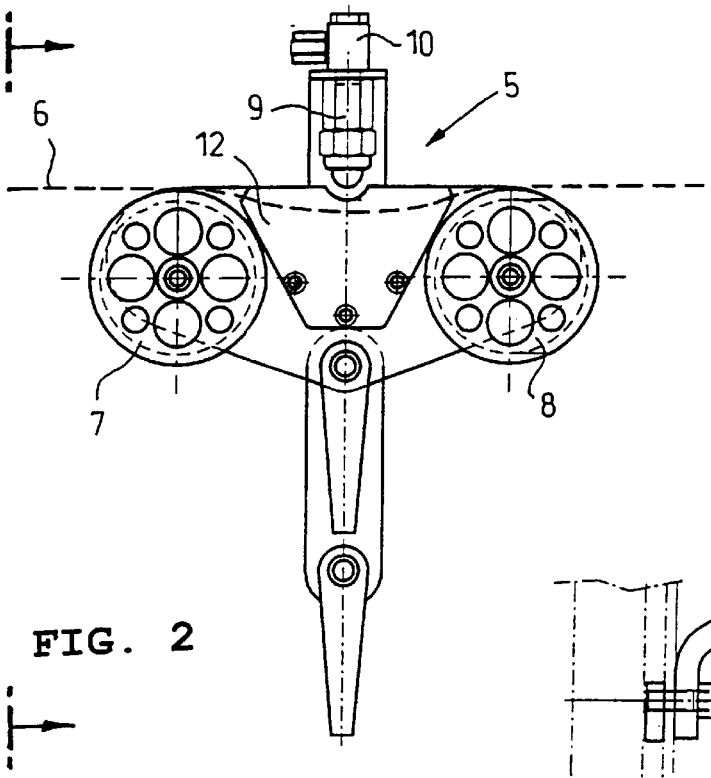
FIG. 2 is a general view of a first embodiment of the arrangement of the invention.
Figure 3:
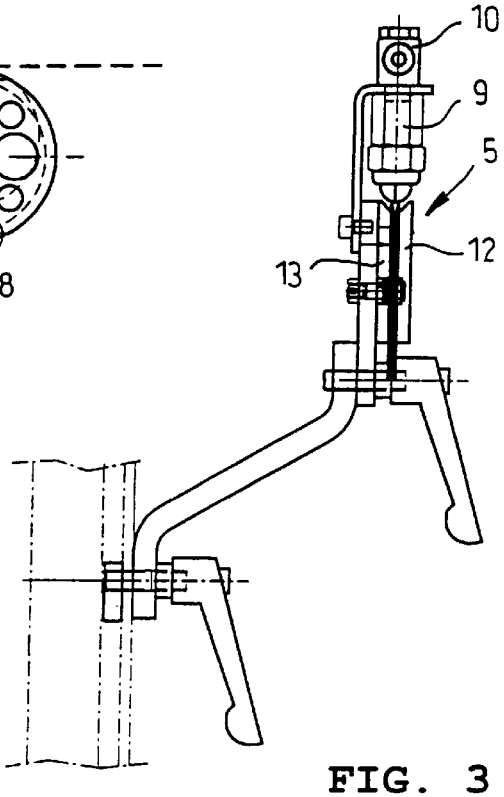
FIG. 3 shows the embodiment of FIG. 2, viewed from the direction indicated by arrows III—III.

FIGS. 2 and 3 illustrate an embodiment of the arrangement of the invention on a larger scale. The embodiment of FIGS. 2 and 3 comprises two wheel members 7, 8, acting as support or guide means for the fibre 6, and a nozzle means 9 mounted between them. The nozzle means 9 is provided with a fitting 10 through which a gaseous medium can be supplied to the nozzle means 9. The medium can be, for example, air. The nozzle means 9 produces a medium jet, which is directed to the fibre to generate a force which acts on the fibre 6 transversely in relation to the direction of travel of the fibre, deflecting the fibre transversely in relation to the direction of travel of the fibre. The lateral deflection can be measured, and it can be used in the same way as a dancer. The magnitude of the lateral deflection can be adjusted, for example, by adjusting the jet. The jet may be throttled down, for instance, so that the deflection is corrected by ocular estimate. The nozzle means 9 can also be mounted in such a way that its distance from the fibre 6 can be adjusted, if necessary. The tension can naturally be measured, and the jet—and thereby also the tension—can be adjusted on the basis of the measurement. The pressure of the medium may be, for example, the normal pressure of a compressed-air system, 6 bar.

An essential feature of the invention is that it is used together with prior art dancers to eliminate their drawbacks, which are evident particularly in the case of rapid tension variations, as stated above. In other words, the invention is used for compensating for the tension variations caused by the inertia of a dancer.

The embodiment shown in FIGS. 2 and 3 can be positioned at any point of a fibre path where it is particularly important to remove tension or velocity variations. The invention is especially advantageous, for example, at the point of the fibre path just before spooling, when the fibre is wound on a reel. This position is illustrated in principle in FIG. 1. Another advantageous point is immediately after the reel when the fibre is wound off the reel. Yet another advantageous point is before a coating device or a similar device.

The invention allows tension variation occurring at the lever dancer because of a step-like change in the speed, for instance, to be eliminated quite efficiently. Without the invention, i.e. if only a lever dancer were used, the tension would fluctuate detrimentally, since a lever dancer always has a certain structural inertia and the fibres have a certain structural flexibility. The invention allows such detrimental vibration to be eliminated.

Figure 4:
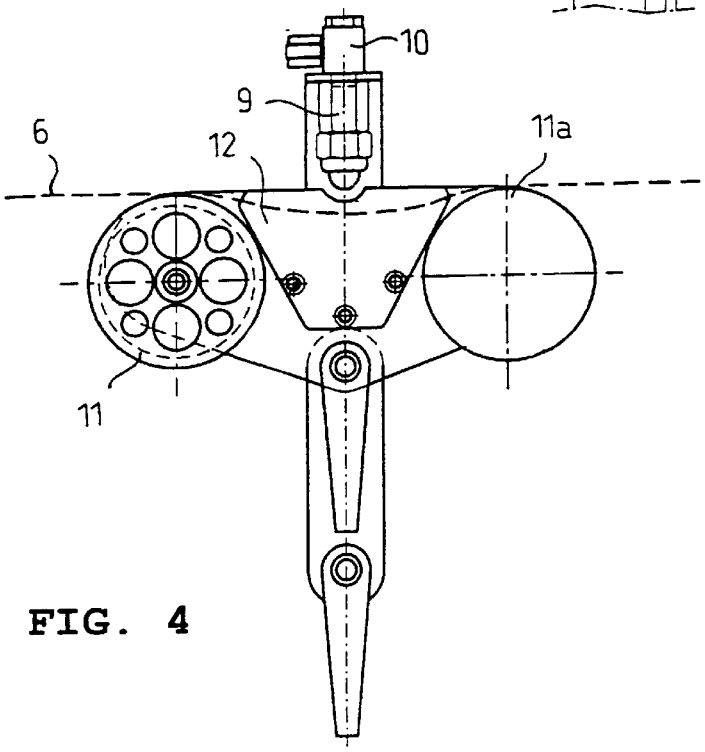
FIG. 4 is a general view of a second embodiment of the arrangement of the invention.

FIG. 4 shows a second embodiment of the arrangement of the invention. In this embodiment, the arrangement comprises only one wheel member 11 acting as a support or guide means for the fibre, and a nozzle means 9 adjacent to it. The idea of this embodiment is that the arrangement is mounted on a spooler in such a way that a part of the fibre path, e.g. a part of the spooler such as the dividing wheel, also serves as a support or guide wheel for the fibre on the other side of the nozzle means 9. The embodiment of FIG. 4 operates, in principle, in the same way as the embodiment of FIGS. 2 and 3. Instead of a dividing wheel, the other support or guide wheel may also be the actual reel on or off which the fibre is wound.

The invention can also be applied in such a manner that the arrangement comprises merely a nozzle means 9 which is intended to be mounted between two support or guide means belonging to the fibre path. In this embodiment, the wheel members of the embodiment shown in FIG. 2 are thus replaced, in a way, by support and guide means already existing in the fibre path, i.e. guide wheels, ceramic guide rings or similar elements.

In the examples illustrated in the figures, the fibre 6 is arranged to pass between two wall portions 12, 13 at the nozzle means 9 so that the travel of the fibre is controlled in the lateral direction. It is, however, also possible to control the travel of the fibre in the lateral direction in some other way, for example by flow technology (e.g. air flow curtains).

Figure 5:
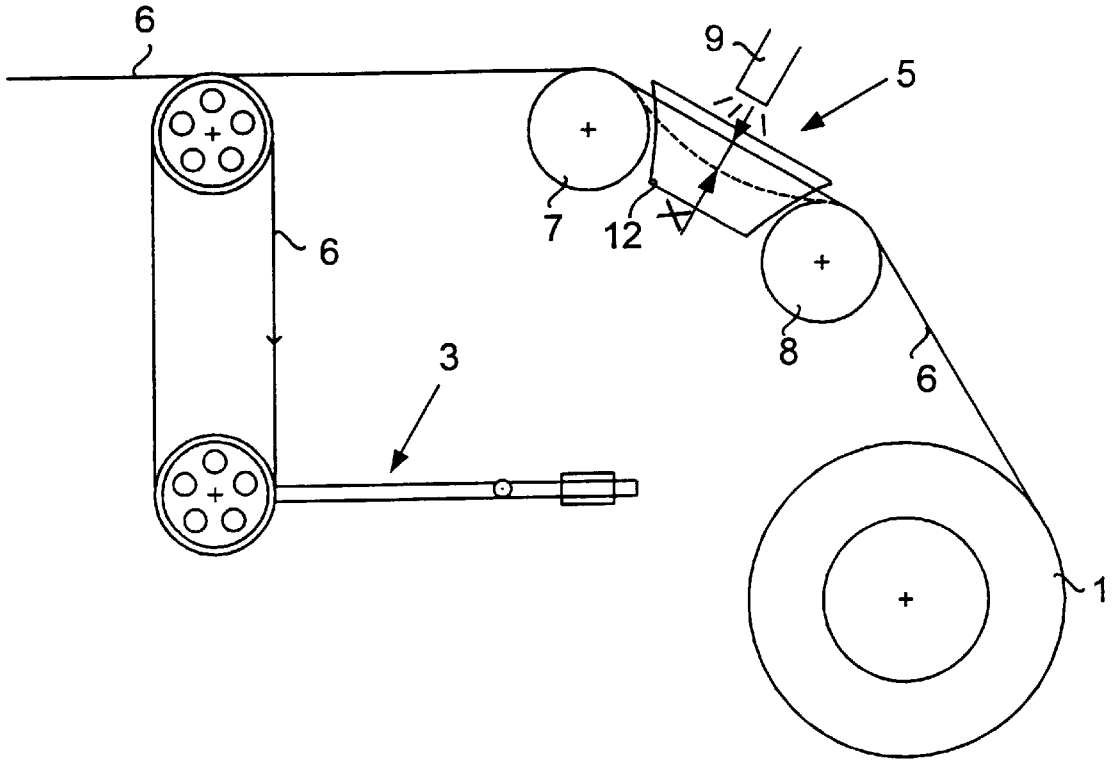
FIG. 5 is a general view of a spooler provided with an arrangement of the invention.

FIG. 5 is a general view of a spooler provided with an arrangment of the invention. In FIG. 5, the same reference numbers have the same significance as in FIGS. 1 to 4. The example shown in FIG. 5 comprises a lever dancer 3 of light construction; the aim has been to make the moment of inertia of the lever dancer as low as possible. A weight was attached to the lever dancer to generate a 30 g tension in the fibre 6, when the fibre is stationary or moves at a steady speed. An arrangement 5 of the invention was mounted between the lever dancer 3 and the reel 1. In the arrangement 5, the diameters of the wheel members 7, 8 were 60 mm, and the distance between their centres was 130 mm. The pressure of the jet of compressed air from the nozzle means 9 was adjusted to 1.8 bar; with this pressure, the fibre 6 was deflected from its centre line by 2 to 3 mm. The deflection is shown in FIG. 5 by x. It was found that with a pressure of 5 bar the deflection x of the fibre 6 was 7 to 8 mm. The pressure of 1.8 bar was found to be optimal for improving the spooling result without significantly increasing the tension of the fibre.

In the testing equipment used, the typical maximum speed at which the spooling succeeded without the arrangement 5 was 600 m/min. With higher speeds, the risk of "loose loops" on the reel became too high in view of the production. When the arrangement 5 was used in addition to the lever dancer, the safe maximum speed was as high as 850 m/min.

Loose loops cause attenuation steps which are easy to measure in the fibre on the reel. In normal production, such attenuation steps cannot be allowed. In addition to the increase in step-like attenuation caused by loose loops, the quality of the spooling result can be assessed on the basis of the magnitude the additional attenuation caused by microbendings of the fibre. The main principle is that the more even the quality of spooling, the fewer microbendings and the less additional attenuation caused by them. When the arrangement 5 was used in addition to a lever dancer 3, the attenuation obtained in the tests with a single mode fibre was 0.004 dB/km lower on the average than when only a lever dancer 3 was used. Since it can be estimated that high-quality spooling causes an increase of up to 0.02 dB/km in the attenuation, the arrangement 5 can be estimated to have reduced the increase in attenuation caused by spooling (microbendings) by at least 20%.

The improved spooling quality could also be observed ocularly. The evenness of the spooling result at a speed of 850 m/min when the arrangement 5 was used was clearly better by ocular assessment than the spooling result at a speed of 600 m/min without the arrangement.

The embodiments described above are not intended to limit the invention in any way, but the invention can be modified quite freely within the scope of the claims. Thus it will be clear that the arrangement of the invention or its details do not necessarily have to be as shown in the figures, but other kinds of solutions are also possible. It will therefore be clear that the structures used for securing the arrangement can be selected completely freely in each case. The invention is not limited to any certain dancer type, but the invention can be used with all prior art dancers to eliminate the drawbacks of the dancer type concerned.

What is claimed is:

1. In a fibre treatment process, a method for leveling out tension variation in a fibre, and wherein tension in the fibre is provided by means of a dancer; the method comprising the steps of locating a contactless fibre deflecting device between two support and guide means in proximity to the dancer; and deflecting the fibre by a jet of gaseous medium from said contactless fibre deflecting device, said jet directed transversely in relation to a direction of travel of said fibre to thereby compensate for tension variations caused by inertia of said dancer.

2. A method according to claim 1, including measuring a magnitude of the deflection which is transverse in relation to the direction of travel of the fibre and which is caused by the jet of the gaseous medium, and using the deflection in the same way as a dancer.

3. A method according to claim 1, including measuring the deflection of the fibre, and adjusting the jet of the gaseous medium according to the measurement results.

4. A method according to claim 1, wherein the gaseous medium is air.

5. In a fibre treatment apparatus including a fibre path, a reel, and at least one dancer in said path for establishing desired tension in the fibre, but wherein tension variations are caused by inertia of said at least one dancer, an improvement comprising a contactless deflecting device located between two support and guide means in proximity to said at least one dancer, said contactless deflecting device comprising means for directing a jet of a gaseous medium through a nozzle toward said fibre in a direction transverse to said fibre path such that said fibre is deflected to thereby level out the tension variations caused by said at least one dancer.

6. An arrangement according to claim 5, wherein the support and guide means consist of two separate wheel members.

7. An arrangement according to claim 5, wherein the support and guide means comprise one separate wheel member and a part of the fibre path which is arranged to serve as a second support and guide means.

8. An arrangement according to claim 5, wherein the support and guide means comprise existing support and guide means of the fibre path.

9. An arrangement according to claim 5, wherein the fibre is arranged to pass between two wall portions at the nozzle.

10. An arrangement according to claim 5, wherein the travel of the fibre at the nozzle is arranged to be controlled by means of flow technology.

11. An arrangement according to claim 6, wherein the medium jet from the nozzle is an air jet.

* * * * *